United States Patent [19]

Casset et al.

[11] Patent Number: 5,072,872

[45] Date of Patent: Dec. 17, 1991

[54] DEVICE FOR TRANSPORTING MATERIALS IN STRIP, SHEET, OR FILAMENT FORM

[75] Inventors: Jacques Casset, Sallanches; Gerard Lavorel, Pringy, both of France

[73] Assignee: A2C Groupe Pratic-Ademva, France

[21] Appl. No.: 480,604

[22] Filed: Feb. 15, 1990

[30] Foreign Application Priority Data

Feb. 15, 1989 [FR] France ..... 89 02207

[51] Int. Cl.[5] ..... B65H 20/00

[52] U.S. Cl. ..... 226/176; 226/186

[58] Field of Search ..... 226/176, 177, 186, 187; 83/261

[56] References Cited

U.S. PATENT DOCUMENTS

| | | | |
|---|---|---|---|
| 2,783,996 | 5/1957 | Forkner | 226/145 X |
| 2,873,968 | 2/1959 | Grobman | 271/51 |
| 3,067,999 | 12/1962 | Skeen | 83/261 X |
| 3,277,856 | 10/1966 | Ricci | 83/261 X |
| 3,493,159 | 2/1970 | Balunoz, Jr. et al. | 226/154 |
| 3,661,310 | 5/1972 | Gross | 226/108 |
| 4,043,494 | 8/1977 | Bickford et al. | 38/261 X |
| 4,048,831 | 9/1977 | Fabian et al. | 226/177 X |
| 4,119,256 | 10/1978 | Vogtmannetal | 226/177 |
| 4,759,485 | 7/1988 | Braun et al. | 226/176 |

FOREIGN PATENT DOCUMENTS 3000639 7/1981 Fed. Rep. of Germany .

*Primary Examiner*—Daniel P. Stodola
*Assistant Examiner*—P. Bowen
*Attorney, Agent, or Firm*—Oliff & Berridge

[57] ABSTRACT

Feeders for transporting materials in strip, sheet, or filament form include an adjustable stop mechanism for setting the clearance between feed rolls. The stop mechanism allows the rolls to be moved apart to release the material form the rolls. In one embodiment, the stop mechanism includes a spring, the force of which is overcome to allow release of the rolls. The stop mechanism includes an eccentric mounting for precisely setting clearance between feed rolls. In another embodiment, a pair of articulated levers are provided, a first of which carries an adjustment screw bearing against the second lever. A cam engages the second level to cause the rolls to move to a material-releasing position. The cam can be driven by the drive system of machine on which the feeder is mounted so that the material can be released in relation to machine operation.

6 Claims, 3 Drawing Sheets

DEVICE FOR TRANSPORTING MATERIALS IN STRIP, SHEET, OR FILAMENT FORM

FIELD OF THE INVENTION

The present invention relates to a device for transporting materials in strip, sheet, or filament form. In particular, it relates to feeding such materials for processing by machine tools.

BACKGROUND OF THE INVENTION:

Feeding and advancing the material in the machine tool is an operation that requires maximum precision if the work is to be performed correctly. Otherwise, the machine could be damaged or the material processed in a defective manner.

Transport devices are known comprising two parallel rolls, compressing the material between them and driven to rotate in opposite directions, causing the material to advance by friction.

A drive motor is connected to one of the rolls, which transmits its motion to the other roll through a set of two gears keyed to their shafts. One of the rolls is transversely displaceable, i.e. in a direction essentially perpendicular to that in which the material is advanced, so that it can be moved away from the other roll to allow the material to be inserted or to release the material when it is engaged by those elements of the machine which position and guide it as it is processed.

Of course, the distance between the rolls is determined by the thickness of the material being processed and the desired clamping pressure, which is in turn determined by the nature of the material and/or its surface quality.

U.S. Pat. No. 2,783,996 and German Patent 30 00 639 describe this type of device, in which the transversely movable roll is supported by a chassis forming a cover and articulated on a shaft mounted parallel to those of the rolls, with the rotational link between the two rolls being provided by an even number of gears, at least four, one of which is keyed to each shaft of the roll, one being freely supported by a shaft coaxial with the shaft on which the chassis is articulated, and one intermediate gear meshing with the one mentioned above which is free to rotate, and with one of the two gears keyed to the roll shafts.

The design shown in U.S. Pat. No. 2,783,996 does not provide suitable means, jacks for example, to press the movable roll against the material held between the two rolls, nor means for sufficiently separating the rolls to feed the material. The result is a significant lack of precision in feeding the material and in releasing it.

The design shown in German Patent 30 00 639 provides a chassis pivoting on a shaft whose height is adjustable, a jack to move the rolls apart or closer together by exerting a pressure on them, and a cam which abuts the chassis to release the material. This device has the disadvantage of being complicated to manufacture and inaccurate to regulate as regards the spreading of the rolls and the releasing operation, due to the forces exerted on the chassis and the shaft on which it pivots.

SUMMARY OF THE INVENTION

The goal of the present invention is to overcome these disadvantages by providing a device which is simple to manufacture and which allows perfect precision in the adjustment of the separation of the rolls.

To this end, the device according to the invention, which is of the type comprising two parallel rolls designed to compress the material between them and rotationally driven in opposite directions, one of said rolls being movable transversely and supported by a chassis forming a cover articulated on a fixed shaft parallel to those of the rolls, comprises in combination, at least one pneumatic double-acting jack connected to the chassis in such manner-that by pivoting the chassis, the rolls are caused to press on the material or to move apart, and an adjustable stop located on the trajectory of the chassis, to which it is connected at a point located near the point(s) of application of the jack (s) to it, said stop being designed to allow adjustment of the distance between the rolls and to limit the travel of the chassis in the pressing direction, said adjustable stop also being designed so that, in cooperation with appropriate means, it can oppose the action of the jack(s) and release the material.

In the device according to the invention, the adjustable stop operates both during adjustment of the distance between the rolls and during the releasing operation. The combination of the action of the jack(s) and the adjustable stop makes it possible, firstly, after adjusting the distance between the rolls and exercising a pressure on the movable roll, to keep this distance perfectly constant so that the material can advance precisely, and secondly, to ensure that the rolls exert the desired clamping pressure as a function of the material being processed. In addition, because of this arrangement, the distance between the rolls is kept perfectly precise during the releasing operation.

The device is simple to manufacture and is highly accurate; the chassis is not subjected to high torsional forces The jack(s) is/are controlled by an electronic encoder mounted on the outside of the crankshaft of the machine, so that the pressure exerted by the rolls is coordinated with the processing of the material by the elements of the machine.

Preferably, the adjustable stop is composed of a cylinder comprising a chamber accommodating a spring on which a piston acts, the rod of said piston being articulated at its free end to the cross member of the above mentioned chassis by a shaft fitted in a hole located coaxially with the piston, the end of said cylinder having at its end opposite the one traversed by the piston rod, a bore engaging an eccentric supported by a shaft whose angular position is adjustable..

When air is injected into the lower chamber(s) of the jack(s) at a pressure sufficient to move the chassis but not enough to cause the piston to compress the spring, the chassis moves only along the path allowed by the hole that receives the shaft connecting the stop to the chassis. This displacement allows the material to be released. When air is injected into the lower chamber(s) of the jack(s) at a pressure sufficient to cause the piston to compress the spring, the chassis moves along the path permitted by the compression of the spring. The rolls can thus be spread to allow the material to be inserted between them. Adjusting the angular position of the eccentric allows the stop assembly to be shifted to adjust the spread of the rolls as a function of the thickness of the material to be transported.

According to one embodiment of the invention, the adjustable stop is composed of a clamp articulated on the chassis and fitted with a screw abutting a lever mounted so as to pivot at one end around a shaft attached to the frame of the machine, the other end of said lever being in contact (direct or not) with a cam collar rotationally linked to a shaft driven by the crankshaft of the machine.

The oscillating pivoting motion transmitted to the lever by the cam collar is transmitted to the chassis through the screw and clamp, releasing the material. Adjusting the screw changes the position of the clamp relative to the lever and hence to the chassis, so that the distance between the rolls can be adjusted as a function of the material to be transported. To grasp the material between them, the rolls are simply spread by injecting compressed air into the lower chamber(s) of the jack(s). This embodiment has the advantage over the first embodiment described, of avoiding the use of an electronic device to coordinate the action of the jack(s) with the passage of the material and of limiting the speed due to the inertia of the jack(s).

BRIEF DESCRIPTION OF THE DRAWINGS

In any event, the invention will be readily understood with the aid of the following description, with reference to the attached schematic diagram, showing as nonlimiting examples, two embodiments of the device according to the invention.

DESCRIPTION OF THE PREFERRED EMBODIMENTS

Figure 1:
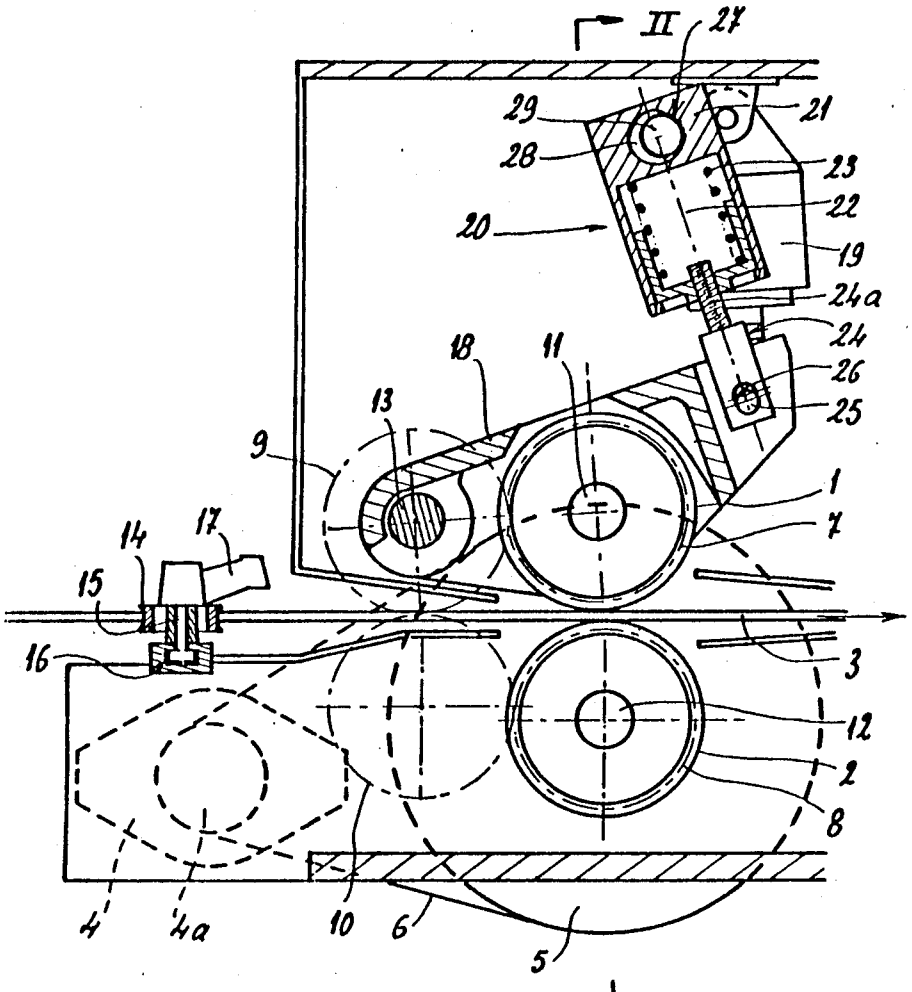
FIGS. 1, 3, and 4 are lengthwise sections through a first embodiment of the invention, in various operating positions.
Figure 4:
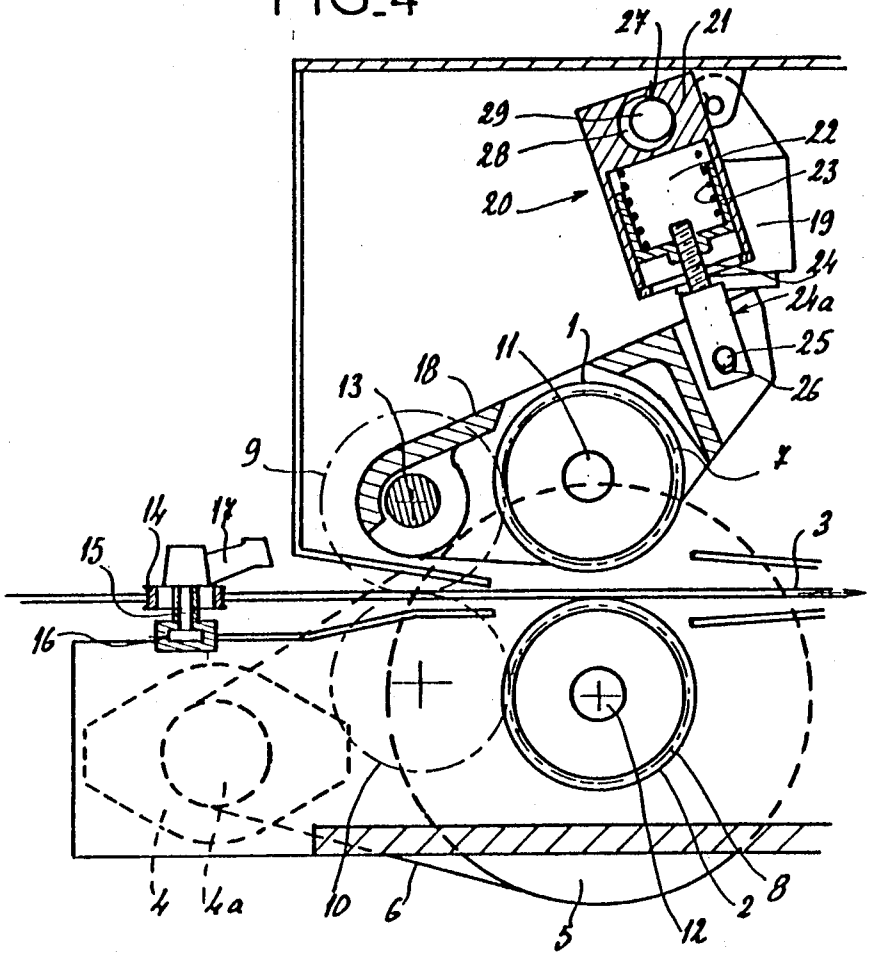
Figure 3:
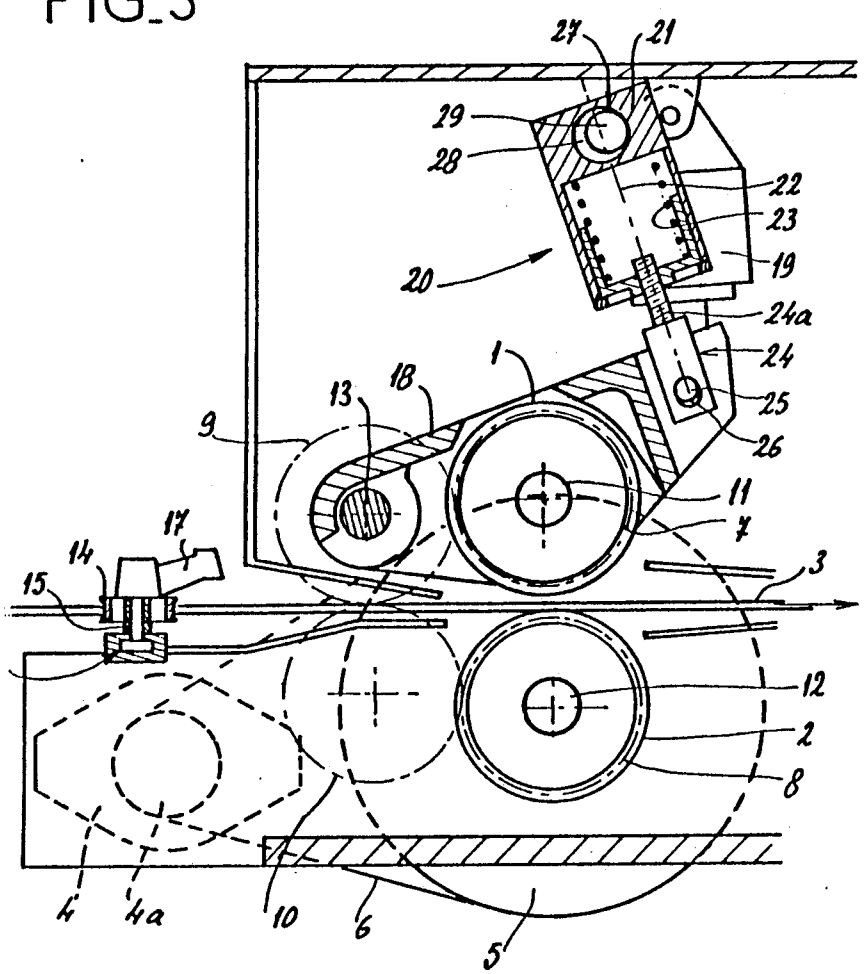

This device comprises two rolls 1 and 2 designed to compress a material 3 to advance it, said material being in strip form and located between said rolls. Rolls 1 and 2 are rotationally driven in opposite directions to advance the material by friction in the direction indicated by the arrow. Roll 2 is driven by a hydraulic motor 4 through two gears 4*a* and 5 and a timing belt 6; roll 1 is driven by roll 2 through a set of four gears 8, 10, 9, and 7 shown by the dot-dashed lines in FIGS. 1, 3, and 4. Gears 7 and 8 are keyed to shafts 11 and 12 respectively of rolls 1 and 2. Gear 9 is supported freely on a shaft 13. Intermediate gear 10, mounted on a shaft that is integral with the frame, meshes with gear 9 and gear 8.

The device also comprises guide wheels 14 for material 3, each of said wheels being mounted on a shaft 15 engaged in a transverse slide 16 allowing it to be displaced and consequently permitting adjustment of the distance between said wheels as a function of the width of material 3, each shaft 15 being capable of being locked in the desired position by a locking element 17.

In addition, roll 1 is supported by a chassis 18 forming a cover, mounted to pivot on shaft 13 and having associated with it two pneumatic double-acting jacks 19 whose piston rods are articulated to chassis 18 and whose bodies are articulated to the frame of the machine.

This device comprises an adjustable stop 20 composed of a cylinder 21 comprising a chamber 22 accommodating a spring 23 compressed between the bottom of chamber 22 and a piston 24 whose rod 24*a* is articulated at its free end to the cross member of chassis 18 by a shaft 25 engaged in a hole 26 coaxial with piston 24. The upper part of cylinder 21 has a bore 27 engaging an eccentric 28 integral with a shaft 29 supported by the frame of the machine.

Figure 2:
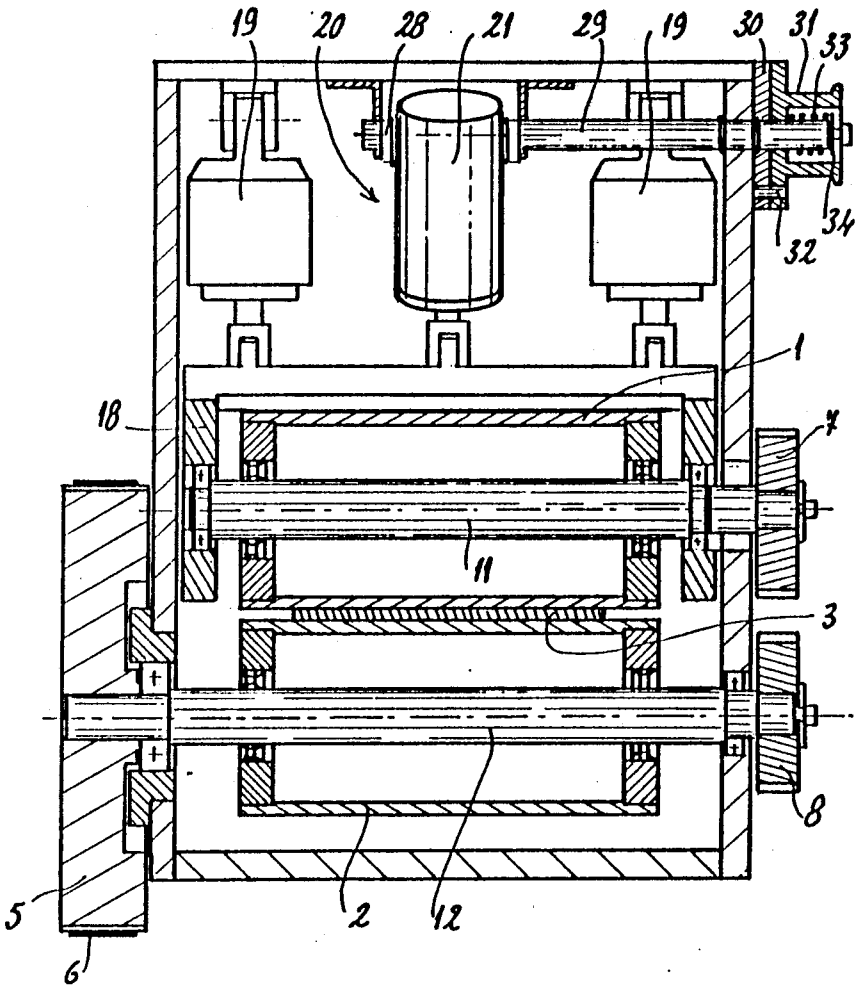
FIG. 2 is a cross section along II—II in FIG. 1.

FIG. 2 shows more particularly that the end of shaft 29 opposite the one supporting eccentric 28 traverses at its center a disk 30 mounted on the frame, as well as a control device 31 rotationally linked thereto while remaining displaceable axially relative thereto. Part 31 has a pin 32 which can engage one of a plurality of holes provided opposite in disk 30. In addition, part 31 contains a spring 33 compressed between its bottom and a stop 34 integral with the same end of shaft 29 to keep it locked against disk 30.

The device according to the invention operates as follows. As the material advances, jacks 19 act on chassis 18 to squeeze material 3 between rolls 1 and 2 which are themselves caused to rotate by motor 4. When air is injected into the lower chambers of jacks 19 at a pressure sufficient to cause chassis 18 to pivot, but not enough to cause piston 24 to compress spring 23, i.e. in practice about 2 bars, chassis 18 pivots only along the path allowed by oblong hole 26. This pivoting of chassis 18, corresponding to a spreading of the rolls by about 0.5 mm, releases the material, as shown more particularly in FIG. 3. When air is injected into the lower chambers of jacks 19 at a pressure sufficient for piston 24 to compress spring 23, i.e. about 5 bars, chassis 18 pivots along the path allowed by the compression of spring 23. Rolls 1 and 2 spread so that material 3 can be accommodated easily between them, as shown more particularly in FIG. 4.

Part 31 can be moved away from disk 30 to fit pin 32 in the hole opposite, provided in disk 30, to set the angular position desired, so that through the intermediary of axis 29, eccentric 28 is pivoted so that it displaces the adjustable stop assembly as a function of the thickness of the material 3 to be fed.

Figure 5:
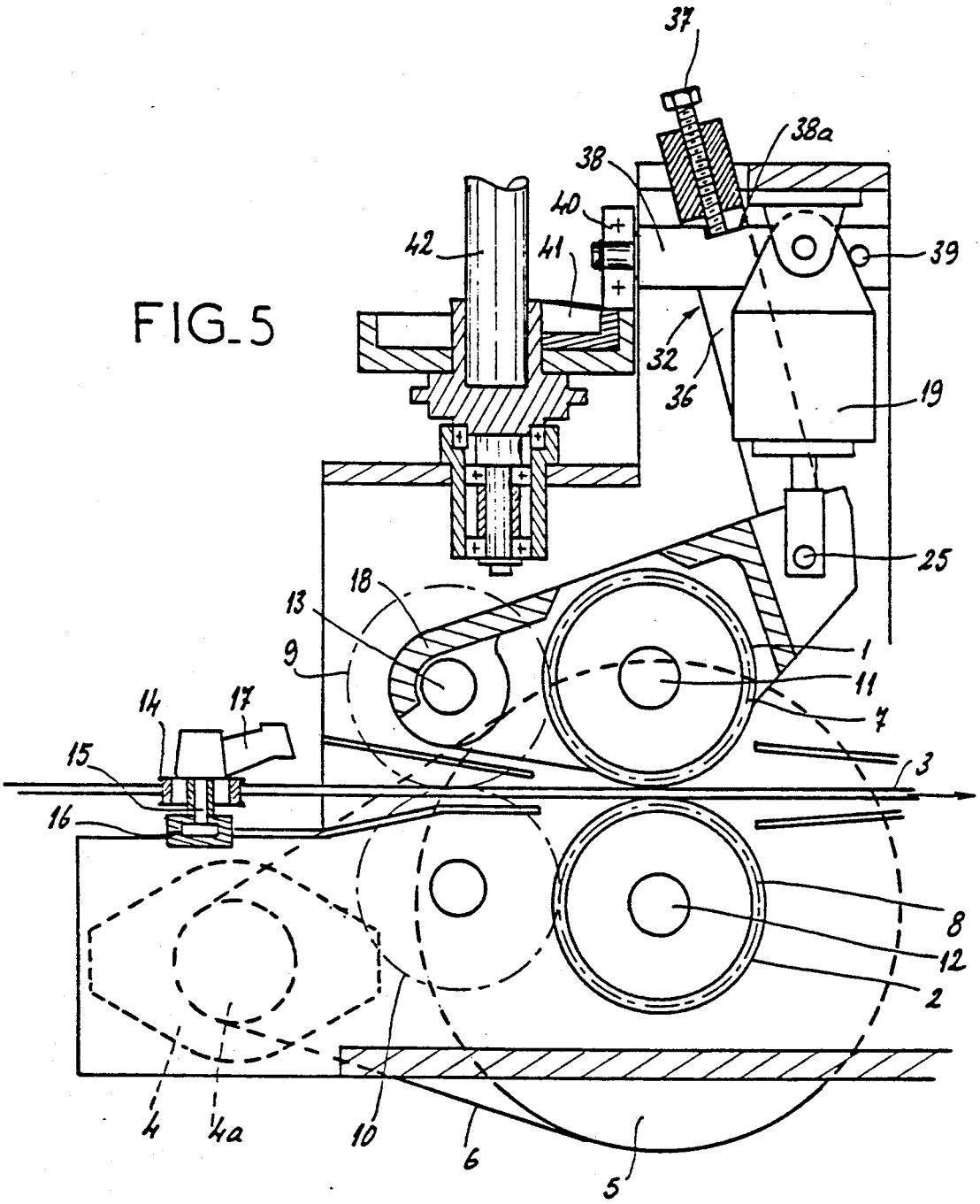
FIG. 5 is a lengthwise section of a second embodiment of the invention.

FIG. 5 shows another embodiment of the device wherein the mechanism for spreading the rolls is different. Otherwise, the device comprises elements identical to those described above, which have the same reference numbers.

In this embodiment, adjustable stop 32 is composed of a clamp 36 articulated to chassis 18 and equipped with a screw 37. The end of screw 37 abuts a lever 38 with a flat 38*a* provided for the abutment of screw 37. Lever 38 is mounted to pivot at one end around a shaft 39 mounted on the frame of the machine, its other end bearing a cam wheel 40 in contact with a cam collar 41 caused to rotate on a shaft 42 driven by the crankshaft of the machine.

Cam collar 41 raises lever 38, which transmits its motion to chassis 18, thus releasing material 3. Adjusting screw 37 alters the position of clamp 36 relative to lever 38 and hence that of chassis 18, so that it is possible to regulate in this manner, the distance between rolls 1 and 2 as a function of the thickness of material 3. The space between rolls 1 and 2, to engage material 3 between them, is created by simply injecting air into the lower chambers of jacks 19, causing chassis 18 to pivot along with clamp 36 articulated thereto.

What is claimed is:

1. A device for transporting material in continuous form, comprising:

a body;

a pair of parallel drive rolls rotatably mounted on the body for receiving said material therebetween;

means for driving the drive rolls in opposite directions;

a chassis, one of said drive rolls being mounted on the chassis;

means pivotally mounting the chassis on the body for movement about an axis parallel to the axes of rotation of the drive rolls, whereby said one drive roll is movable transversely with respect to the other drive roll;

a double-acting jack;

means for connecting the jack to the chassis, whereby said jack forces the chassis to pivot in two directions such that said one roll is caused to move transversely with respect to the other roll; and adjustable stop means mounted on the chassis for limiting movement of the chassis in the pressing direction in opposition to action of the jack, adjusting the distance between the rolls independent of the action of the jack and enabling the chassis to move and also limiting movement of the chassis in a direction to allow the drive rolls to move apart, thereby releasing continuous material disposed between the rolls.

2. A device according to claim 1, wherein the adjustable stop means comprises:

a cylinder having a chamber;

a spring in the chamber;

a piston in the chamber positioned to act on the spring;

a piston rod on which the piston is mounted;

articulated mounting means for mounting a free end of the piston rod to the chassis, the articulated mounting means including a shaft on the chassis and means on the piston rod for receiving the shaft; and adjustable mounting means for mounting the end of the cylinder opposite the piston rod on the body;

the adjustable mounting means comprising: a bore; an eccentric engaging the bore; and means for adjusting the angular position of the eccentric with respect to the bore.

3. A device as in claim 2, wherein the means on the piston rod for receiving the shaft comprises an elongate hole in the piston rod.

4. A device for transporting material in continuous form, comprising:

a body;

a pair of parallel drive rolls rotatably mounted on the body for receiving said material therebetween;

means for driving the drive rolls in opposite directions;

a chassis, one of said drive rolls being mounted on the chassis;

means pivotally mounting the chassis on the body for movement about an axis parallel to the axes of rotation of the drive rolls, whereby said one drive roll is movable transversely with respect to the other drive roll;

a double-acting jack connected directly between the body and the chassis;

means for connecting the jack to the chassis, whereby said jack forces the chassis to pivot in two directions such that said one roll is caused to move transversely with respect to the other roll; and adjustable stop means mounted on the chassis for limiting movement of the chassis in the pressing direction in opposition to action of the jack, adjusting the distance between the rolls independent of the action of the jack and moving the chassis in a direction to allow the drive rolls to move apart, thereby releasing continuous material disposed between the rolls.

5. A device according to claim 4, wherein the adjustable stop means comprises:

a clamp;

means pivotally mounting the clamp on the chassis;

a screw mounted on the clamp;

a lever, the screw being positioned to about the lever;

means for pivotally mounting the lever on the body;

a cam means for movably mounting the cam on the body;

said lever including means for engaging the cam, whereby the lever moves in response to movement of the cam.

6. A device as in claim 5, wherein the cam is a cam collar and the cam mounting means includes means for rotatably mounting the cam collar.

* * * * *